United States Patent [19]

Miller

[11] Patent Number: 4,466,240

[45] Date of Patent: Aug. 21, 1984

[54] FUEL NOZZLE FOR GAS TURBINE ENGINE WITH EXTERNAL AND INTERNAL REMOVAL CAPABILITY

[75] Inventor: Guy W. Miller, Vernon, Conn.

[73] Assignee: United Technologies Corporation, Hartford, Conn.

[21] Appl. No.: 315,095

[22] Filed: Oct. 26, 1981

[51] Int. Cl.[3] ..... F02C 7/22

[52] U.S. Cl. ..... 60/39.31; 60/740

[58] Field of Search ..... 60/39.31, 734, 740, 60/741; 239/283, 390, 397, 600

[56] References Cited

U.S. PATENT DOCUMENTS

| | | | |
|---|---|---|---|
| 2,548,904 | 4/1951 | Neal et al. | 60/740 |
| 2,944,388 | 7/1960 | Bayer | 60/740 |
| 3,159,971 | 12/1964 | Moebius et al. | 60/740 |
| 3,879,940 | 4/1975 | Stenger et al. | 60/740 |

*Primary Examiner*—Louis J. Casaregola
*Assistant Examiner*—Timothy S. Thorpe
*Attorney, Agent, or Firm*—Norman Friedland

[57] ABSTRACT

This invention relates to the mounting and support of fuel nozzles for gas turbine engines with the capability of removal externally and internally so that external removal capability negates the necessity of turbine and combustor teardown and allows access without engine removal from the aircraft.

4 Claims, 5 Drawing Figures

FUEL NOZZLE FOR GAS TURBINE ENGINE WITH EXTERNAL AND INTERNAL REMOVAL CAPABILITY

DESCRIPTION

1. Technical Field

This invention relates to fuel nozzles for a gas turbine engine and particularly to the mounting and support thereof with the capability of external and internal removal thereof.

2. Background Art

It has always been desirable to be able to remove the fuel nozzle externally of the engine. This carries the obvious advantage of allowing inspection, cleaning, repairing, removal and the like without tearing down the turbine and combustor sections. Also this enhances the capability of allowing the operator to work on this portion of the engine without requiring the removal thereof from the aircraft.

Moreover, this affords the selective replacement of individual nozzles if turbine temperature pattern correction must be done from the outside.

On the other hand, since coked nozzles tend to cause liner distress, it has been the practice to clean and flow check the nozzles from the inside after removal of the turbine and burner for burner maintenance.

However, because of the cost, weight, durability, complexity and other factors both external and internal removal capabilities in a given installation have not been utilized.

Historically, the selection of whether the removal capability would be internal or external would be a compromise depending on which factors were more favorable to the customer.

We have found that we can obviate the above disadvantages and provide a simple, yet highly durable mounting and support system that allows the external-internal removal of the nozzles. The system contemplated by this invention does not mandate a selection between least desirable features as all the features incidental to the removal system are considered acceptable without being excessively heavy, complicated, and injurious to engine performance.

DISCLOSURE OF INVENTION

An object of this invention is to provide for an annular combustor of a gas turbine engine a mounting system for the fuel nozzles that permits removal internally and externally of the combustor. The system is characterized as being less complex than heretofore systems and reasonably light in weight.

Other features and advantages will be apparent from the specification and claims and from the accompanying drawings which illustrate an embodiment of the invention.

BEST MODE FOR CARRYING OUT THE INVENTION

While in its preferred embodiment this invention will be described as used on an annular combustor and as one skilled in the art will appreciate, the invention could have utility with other types of combustors. Suffice it to say that a suitable combustor and installation for this invention is for the model JT9D engine manufactured by Pratt and Whitney Aircraft of United Technologies Corporation and the details of which are incorporated herein by reference. The fuel nozzle is typically supported to a portion of the combustor liner and as in the case of an annular combustor, a plurality of such nozzles are similarly supported about the circumference of the liner.

Figure 1:
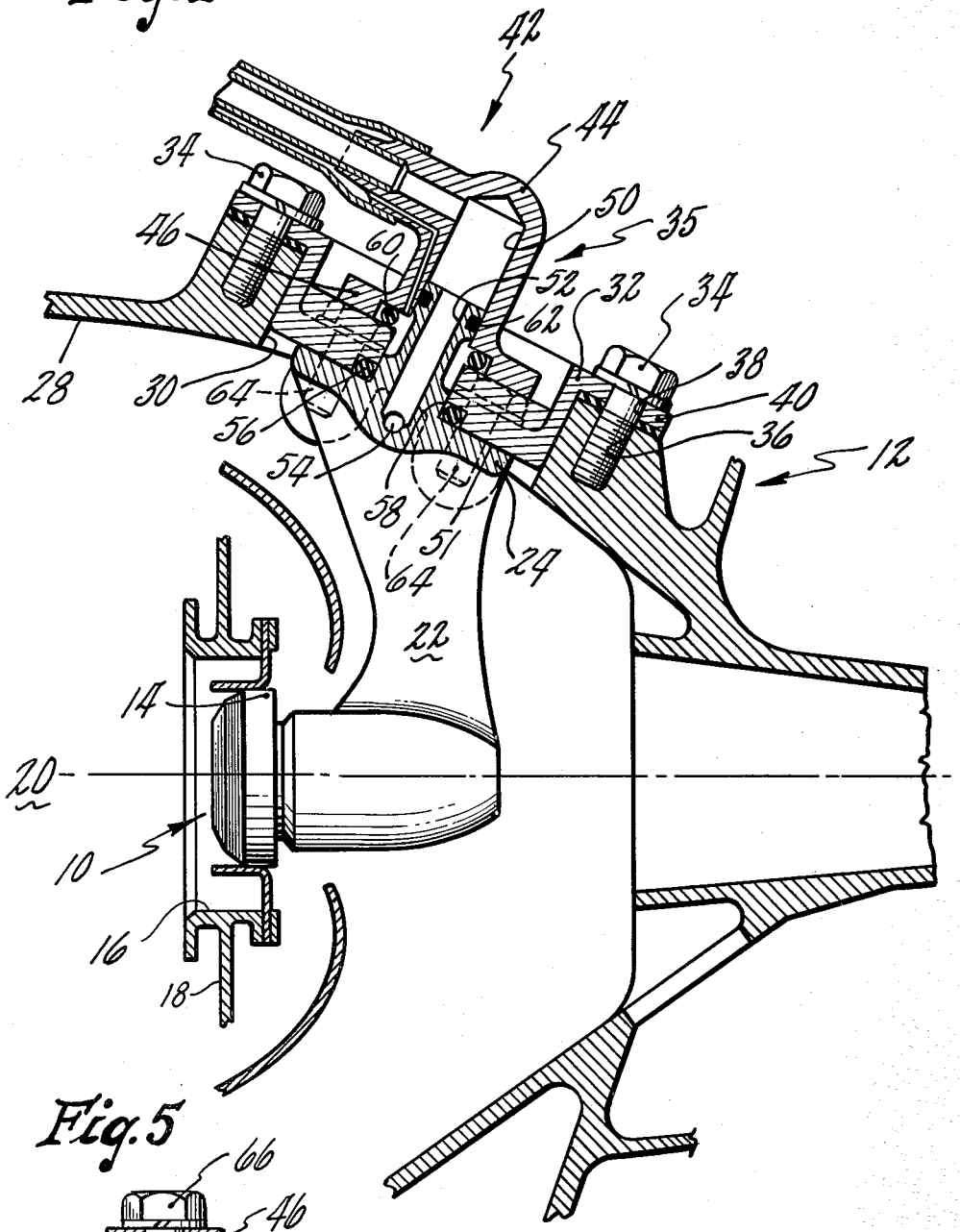
FIG. 1 is a partial view partly in section and partly in elevation illustrating one of several fuel nozzles attached to an annular combustor of a gas turbine engine and taken along lines 1—1 of FIG. 3.

As noted from FIG. 1, a pair of fuel nozzles (only one being shown) generally indicated by reference numeral 10 extends into the annular combustor generally indicated by reference numeral 12. The fuel nozzle nut element 14 is suitably supported in the opening 16 formed in bulkhead 18 at the front end of the combustor for emitting fuel into the combustion zone 20. The fuel nozzle is carried by the pedestal 22 which is secured at its base 24 (a similar pedestal carrying the second nozzle is in the same plane behind this one and is not in view) to the fuel nozzle support structure generally indicated by reference numeral 35.

As noted from FIG. 1, the annular support member 28 carries a plurality of circumferentially spaced openings 30, each of which houses one or more fuel nozzles. The nozzle support 32 is generally U-shaped and fits into the opening and secured to the annular support member 28 by a plurality of bolts 34 engaging the tapped portion 36 aligned with the aperture 38 formed in the annular flange 40.

The fuel line generally indicated by reference numeral 42 which may form a part of a manifold assembly comprises an elbow 44 having a mating flange 46 triangular in shape, bearing against the flat surface 48 formed on support member. A pintle-like member 51 centrally disposed and extending from the base 24 fits into the bore 50 formed in the elbow and connects with the fuel carrying passages. The drilled passages 52 and 54 carry fuel to the respective fuel nozzles in a suitable well known manner to be delivered to the combustor.

Figure 5:
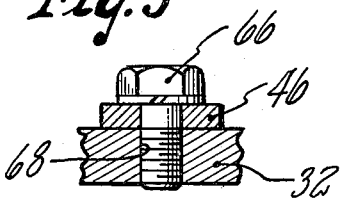
FIG. 5 is a partial sectional view taken along lines 5—5 of FIG. 3.
Figure 2:
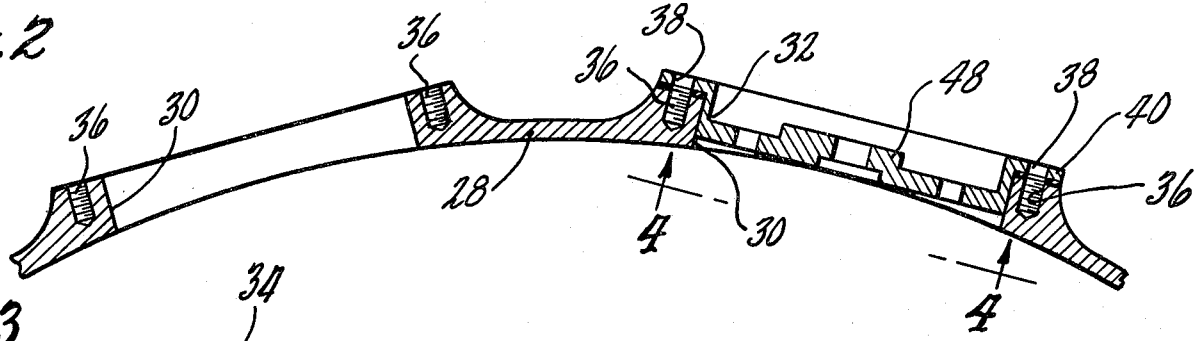
FIG. 2 is a partial sectional view of the combustor liner portion supporting the fuel nozzles.
Figure 3:
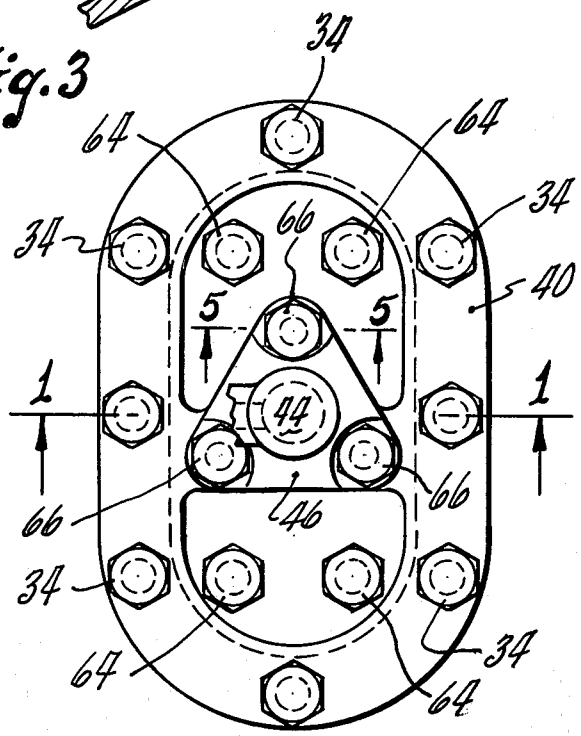
FIG. 3 is a top view of the fuel nozzle manifold connection supported to the combustor liner.
Figure 4:
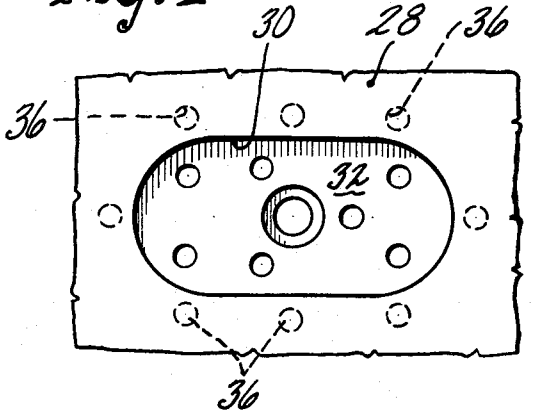
FIG. 4 is a top view illustrating the mounting plate adapted to support the fuel nozzle.

Suitable "O" rings or other seals are judiciously located to assure that fuel does not escape into the engine as would be expected. Thus "O" seal 56 is disposed in groove 58 between the base 24 and pintle member 51; "O" seal 60 is disposed between the support member 32 and elbow 44 and the piston ring seal 62 is disposed between elbow 44 and pintle member 51. Base 24 is secured to the support member 32 by the four bolt assemblies 64 and the elbow 44 is secured thereto by the three bolt assemblies 66. As noted in FIG. 5, bolt 66 engages the tapped hole 68 of support member 32 and shoulders against the triangular-shaped flange 46 of the elbow 44.

In operation to remove the nozzle internally of the burner, the four bolts 64 are retracted. This separates the fuel manifold 42 from the assembly and releases the base 24 from the support 32 allowing the operator to remove the fuel nut 14 and pedestal 22 and base 24 from the assembly. To remove the nozzle assembly externally, the operator removes the plurality of bolt assemblies 34 and lifts the nozzle through aperture 30.

It should be understood that the invention is not limited to the particular embodiments shown and described herein, but that various changes and modifications may be made without departing from the spirit and scope of this novel concept as defined by the following claims.

I claim:

1. A fuel nozzle attachment system for an annular combustor for a gas turbine engine including a generally conically shaped ring-like member having a plurality of spaced apertures each of which are adapted to receive at least one fuel nozzle, a plate retractably supported to said ring-like member having a main body portion spanning said aperture, a flange portion extending about the peripheral edge of said main body overlying said ring-like member about said aperture, securing means accessible from the exterior of said combustor retractably supporting said fuel nozzle in said combustor for permitting removal of said fuel nozzle externally of said combustor when said securing means are retracted, a fuel line having a passage communicating with said fuel nozzle for delivering fuel to said combustor, additional securing means accessible externally of said combustor for retractably securing said fuel nozzle to said main body portion for permitting removal of said fuel nozzle internally of said combustor when said additional securing means are retracted.

2. A fuel nozzle attachment system as in claim 1 wherein said fuel nozzle includes a pedestal adapted to extend into said combustor and a base at the foot of said pedestal, said base having a complimentary surface bearing against said main body and tapped holes in said base for receiving said additional securing means.

3. A fuel nozzle system as in claim 2 including a pintle member extending from said base through an opening in said main body member and into said fuel line.

4. A fuel nozzle system as in claim 3 including seal means surrounding said pintle member adjacent said main body member and adjacent said fuel line.

* * * * *